United States Patent [19]

Curry

[11] Patent Number: 4,915,610

[45] Date of Patent: Apr. 10, 1990

[54] JOINT FINISHING TOOL

[76] Inventor: Emory H. Curry, 619 Morwood Rd., Morwood, Pa. 18969

[21] Appl. No.: 240,498

[22] Filed: Sep. 6, 1988

[51] Int. Cl.[4] ..... E04F 21/165

[52] U.S. Cl. ..... 425/458; 15/235.3; 15/235.4

[58] Field of Search ..... 425/458, 87, 385; 15/235.3, 235.4, 235.6, 235.7; 264/256, 284, 293

[56] References Cited

U.S. PATENT DOCUMENTS

| | | | |
|---|---|---|---|
| 109,073 | 11/1870 | Streeter et al. | 15/235.7 |
| 855,633 | 6/1907 | Herring | 425/458 |
| 867,819 | 10/1907 | Grundmann | 15/235.3 |
| 930,374 | 8/1909 | Harrop | 15/235.3 |
| 1,348,639 | 8/1920 | Grundmann | 15/235.3 |
| 1,646,649 | 11/1927 | Kriegl | 15/235.7 |
| 2,094,703 | 10/1937 | Hitzman | 264/259 |
| 2,198,974 | 4/1940 | Pilant | 15/235.4 |
| 2,270,541 | 1/1942 | Martin | 425/458 |
| 2,278,803 | 4/1942 | Stabbert | 15/235.4 |
| 2,608,853 | 9/1952 | Schrepper | 15/235.7 |
| 3,079,622 | 3/1963 | Smyers et al. | 15/235.7 |
| 3,109,193 | 11/1963 | Erickson | 425/458 |
| 3,174,227 | 3/1965 | House | 33/518 |
| 3,806,268 | 4/1974 | Francis | 15/235.3 |
| 4,155,141 | 5/1979 | Guerra | 15/235.3 |

*Primary Examiner*—James C. Housel

*Attorney, Agent, or Firm*—Fleit, Jacobson, Cohn, Price, Holman & Stern

[57] ABSTRACT

A generally planar panel-like tool is provided including opposite end edge and opposite side marginal portions and the tool includes upper and lower surfaces and a longitudinally extending rib projecting below the lower surface of a cross-sectional shape and size to be received within and moved along a groove formed in a building panel, the rib being substantially the same cross-sectional shape as the the cross-sectional shape of the groove, but of slightly smaller dimensions, whereby the rib may be used to smooth a hardenable fluent material coating within the groove.

5 Claims, 1 Drawing Sheet

JOINT FINISHING TOOL

BACKGROUND OF THE INVENTION

1. Field of the Invention

This invention relates to a tool for applying an adhesive mixture coating to and for embedding in a reinforcing mesh disposed over the outer surface of and in grooves formed in insulation board panels and for thereafter applying an exterior finish coating over the adhesive mixture coating previously applied, the tool being constructed in a manner specifically designed to facilitate application of the adhesive coating as well as the finish coating such that all intersecting surfaces define regular corners for optimum aesthetic purposes.

2. Description of Related Art

Various different forms of tools for applying adhesive and finish coatings heretofore have been designed such as those disclosed in U.S. Pat. Nos. 109,073, 1,646,649, 2,094,703, 2,198,974, 2,278,803, 2,608,853, 3,079,622 and 3,174,227.

However, these previously known forms of tools do not include the overall combination of structural features of the instant invention which coact to enable adhesive and finish coatings applied to intersecting grooved areas of insulation building panels to be such that all intersecting surfaces are substantially planar and straight to thereby define precise and regular corner edges for excellence of aesthetics.

SUMMARY OF THE INVENTION

A relatively new system of reinforcing and finishing exterior wall insulation panels in a manner rendering high aesthetic values involves the formation of non-intersecting or intersecting grooves in the insulation panels and the application of a reinforcing mesh, by an adhesive coating, to the exterior surfaces of the panels and then the application of a finish coating to the reinforced outer surfaces. One system of this type is known as the "Dryvit" system.

After the insulation panels have been installed on a exterior wall and grooved as desired, a reinforcing mesh is applied along each of the grooves of the panels and seated therein and thereafter over the entire outer surfaces of the panels in overlapped relation with the mesh applied to the grooves areas of the panels. An adhesive mix coating including "Portland Cement" is thereafter applied to and embedded in the reinforcing mesh to adhesively secure the mesh to the exterior surfaces of the building panels and after the adhesive mix coating has thoroughly dried an exterior finish coating is applied over the adhesive mix coating.

Difficulty, however, is encountered in smoothing both the adhesive coating and the finish coating within and adjacent the grooves formed in the panels and especially in the areas wherein grooves in the panels intersect. Unless the adhesive and finish coatings each are smoothly applied such that all surfaces thereof are planar and intersecting edges are finished at straight regular corner edges, the aesthetic value of the finished insulated wall is appreciably reduced particularly when ambient light casts shadows in the various grooves.

Accordingly, a need exists for a tool specifically designed to enable a mechanic having reasonable skill to precisely apply given thicknesses of adhesive and finish coatings in a professional manner.

In addition, a need further exists for a tool of the same type wherein an experienced mechanic may apply both the adhesive and the finish coatings in a rapid manner, inasmuch as both coatings must be continuously applied to natural breaks such as corners, expansion or aesthetic joints, or tape lines.

The main object of this invention is to provide an adhesive and finish coating applying tool for use in applying adhesive and finish coatings to mesh reinforced and grooved exterior wall insulation panels.

Another object of this invention is to provide a tool in accordance with the preceding objects and which will enable an experienced mechanic to apply the desired adhesive and finish coatings in a manner such that all coatings are of regular thickness and the surfaces thereof are substantially planar while intersecting surfaces define straight and regular corner edges.

Yet another object of this invention is to provide a coating application tool that will enable a professional quality job to be completed by mechanics having minimal experience.

A final object of this invention to be specifically enumerated herein is to provide a coating application tool in accordance with the preceding objects and which will conform to conventional forms of manufacture, be of simple construction and easy to use so as to provide a device that will be economically feasible, long-lasting and relatively trouble free in operation.

These together with other objects and advantages which will become subsequently apparent reside in the details of construction and operation as more fully hereinafter described and claimed, reference being had to the accompanying drawings forming a pair hereof, wherein like numerals refer to like parts throughout.

DESCRIPTION OF THE PREFERRED EMBODIMENTS

Figure 1:
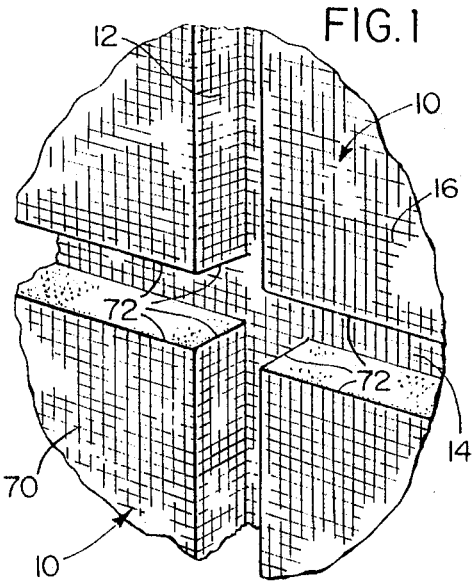
FIG. 1 is a fragmentary perspective view of the outer surface of an outer wall insulation board or panel having intersecting horizontal and vertical grooves formed therein and wherein a horizontal strip of a reinforcing mesh has been applied over the outer surface of the panel and over the surfaces thereof defining the vertical groove as well as over the surface defining the bottom of the horizontal groove.
Figure 2:
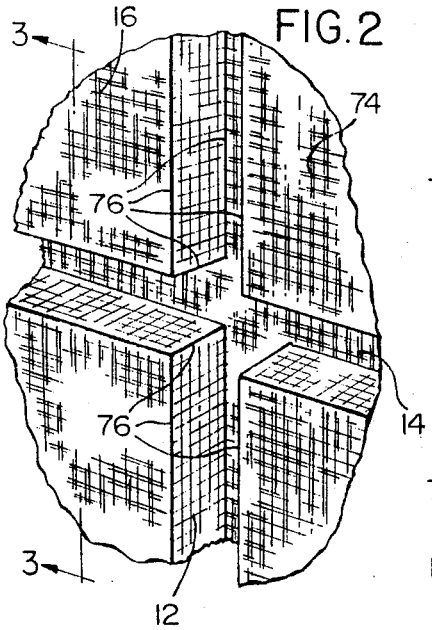
FIG. 2 is a fragmentary perspective view similar to FIG. 1 but illustrating a second vertically extending mesh panel applied over the insulation panel outer surface, over the surfaces thereof defining the horizontal grooves as well as the surface thereof defining the bottom of the vertical groove.
Figure 3:
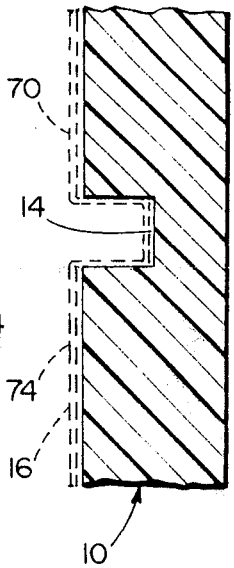
FIG. 3 is a fragmentary vertical sectional view taken substantially upon the plane indicated by section line 3—3 of FIG. 2 and with the overlapping layers of reinforcing mesh illustrated in phantom lines.
Figure 4:
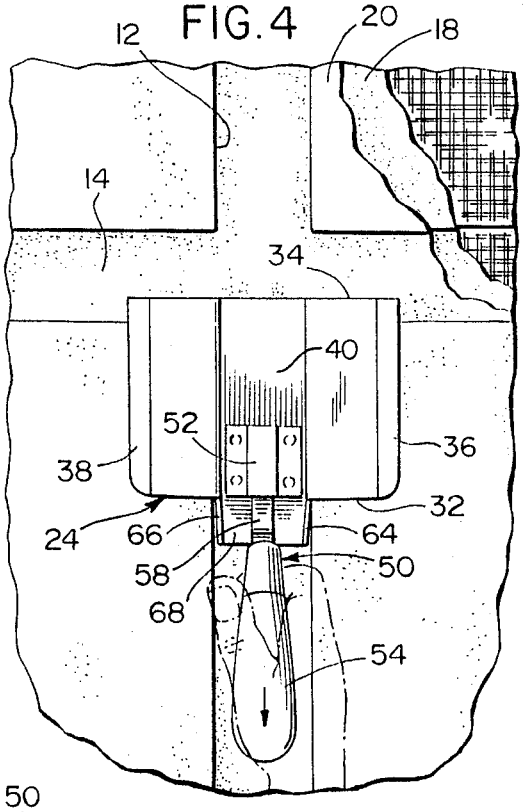
FIG. 4 is an elevational view of the structure illustrated in FIG. 2 and with the initial adhesive coating and second finish coating applied to the external surfaces of the panel, a tool for application of the finish coating being illustrated operatively associated with the panel and portions of the finish and adhesive coatings being broken away.
Figure 5:
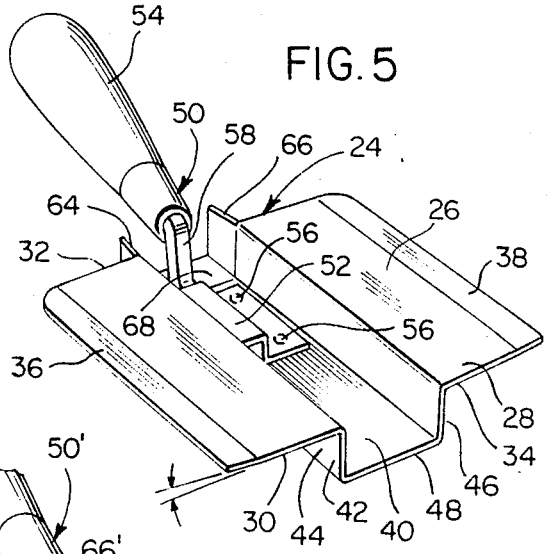
FIG. 5 is a perspective view of the tool illustrated in FIG. 4.

Referring now more specifically to the drawings, the numeral 10 generally designates an exterior wall insulating panel (constructed of foam plastic) having vertical and horizontal grooves 12 and 14 routed therein. Such panels are applied to various types of outer wall surfaces by adhesives (or other means) and are routed after installation to form the grooves 12 and 14 therein.

After a plurality of panels 10 have been mounted on an outer wall surface and routed to form the desired grooves 12 and 14 for aesthetic purposes, reinforcing mesh 16 is applied over the outer and groove surfaces of the panels 10 and a hardenable adhesive coating 18, comprising a fluent, adhesive cementious material, is applied over and embedded within the reinforcing mesh 16. The coating 18 is applied evenly to a thickness only slightly greater than the thickness of the reinforcing mesh and further in a manner whereby all surfaces thereof are substantially planar. Further, all relatively angulated surfaces of the coating are joined by straight regular corner edges.

After the coating 18 has hardened, a second finish coating 20 is applied in the same manner, the second coating also comprising a fluent hardenable coating. The finish coating may be textured by any conventional troweling methods on those portions of the finish coating disposed on the planar outer surface of the panels 10, exclusive of the grooves 12 and 14.

The foregoing comprises a description of a conventional installation of insulation board over an exterior wall surface in a manner such that the finished product is aesthetically pleasing.

The tool of the instant invention has been specifically designed to be used in applying the coatings 18 and 20 and a first form of tool is referred to in general by the reference numeral 24. The tool 24 includes a generally horizontal planar panel 26 constructed of stiff, but slightly flexive material such as sheet stainless steel and the panel 26 is generally rectangular in plan shape and has upper and lower faces 28 and 30. Further, the panel 26 incorporates first and second opposite end edges 32 and 34 and first and second opposite side longitudinal margins 36 and 38. The panel 26 includes an elongated, longitudinally extending channel defining zone 40 thereof centrally intermediate the margins 36 and 38 and the channel defining zone defines a channel of substantially constant cross-sectional shape and size opening outwardly of the upper face 28 and a rib 42 of substantially the same cross-sectional shape, but slightly greater in cross-sectional size, projecting outward of the lower face 30 of the panel 26. The rib 42 includes opposite sides 44 and 46, formed as angulated portions of the panel 26 projecting below the lower face 30, extending lengthwise of the panel 26 and a connecting bight portion 48 extending between and interconnecting the lower marginal edges of the opposite sides 46 and 48.

An elongated handle referred to in general by the reference numeral 50 includes a base end 52 and a handgrip end 54. The handle 50 is arranged longitudinally of the panel 26 with the base end 52 thereof anchored in the channel defining zone 40 to the bight portion 48 through the utilization of spot welding 56. An intermediate length portion 58 of the handle 50 disposed between the base and handgrip ends 52 and 54 is inclined and upwardly offsets the handgrip end 54 relative to the base end 52. In addition, the handgrip end 54 projects endwise outwardly of the first end edge 32 of the panel 26.

The opposite sides 44 and 46 are disposed substantially normal to the bight portion 48 and the medial plane of the panel 26 and the opposite side margins 36 and 38 are slightly upwardly and outwardly inclined.

The opposite sides 46 and 48 include outwardly convergent extensions 64 and 66 projecting outwardly beyond the first end edge 32 of the panel 26 and the corresponding end of the bight portion 48 includes a slightly upwardly and outwardly inclined extension 68 extending between and interconnecting the lower edges of the side extensions 64 and 66, the extensions 64, 66 and 68 defining a slightly tapering nose for the end of the rib 42 remote from the second end edge 34 of the panel 26.

The reinforcing mesh 16 includes a first horizontal strip 70 of mesh material cut along edges 72 and applied over the outer surface of the panel 10 and within the grooves 12 and 14. Also, the reinforcing mesh 16 includes a vertically applied sheet 74 cut along edges 76 applied over the strip 70 and within the grooves 14 and 16. Thereafter, the first coating 18 is applied and after the coating 18 has hardened, the finish coating 20 is applied.

The coating 18 is applied in the areas of the grooves 12 and 14 through utilization of the tool 24 with the rib 42 and the nose defined by the extensions 64, 66 and 68 forming smooth planar coating surfaces in the grooves 12 and 14 and the lower face 30 of the panel 26 on opposite sides of the rib 42 forming planar surfaces of the coating 18 immediately adjacent the grooves 12 and 14, the coating 18 being applied to the major outer surface areas of the panel 10 spaced between grooves 12 and 14 through the utilization of conventional hand tools.

The slightly upwardly and outwardly inclined side margins 36 and 38 of the tool 24 function to assure a substantially undetectable transition between those outer surfaces of the coating 18 closely adjacent the grooves 12 and 14 and the larger areas of the coating 18 applied to the outer surface of the panel 10 between adjacent grooves.

The tool 24 obviously greatly facilitates the application of the coating 18 in and closely adjacent the grooves 12 and 14 so as to achieve planar right angularly disposed intersecting surfaces separated by straight regular corner edges.

After the coating 18 has hardened, the finish coating 20 is applied in the same manner by a tool (not shown) substantially identical to the tool 24 but whose rib (corresponding to the rib 42) is of slightly less width and depth than the rib 42. This of course allows a tool such as the tool 24, but having a slightly smaller dimension rib, to be received within the grooves 12 and 14 already having the hardened coating 18 therein and still provide clearance for the hardenable finish coating 20 to be applied thereover.

Figure 7:
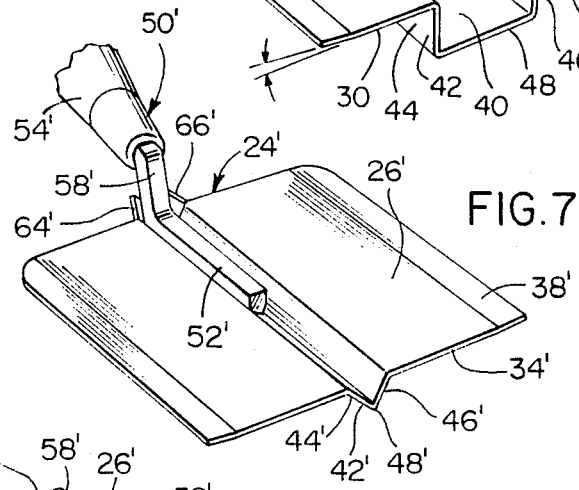
FIG. 7 is a perspective view of a modified form of tool to be used in conjunction with V-shaped grooves.
Figure 6:
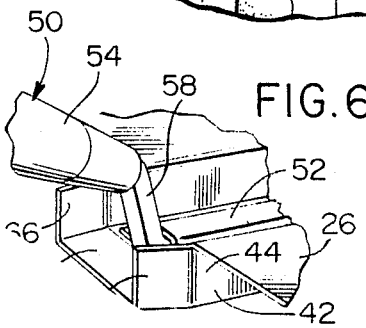
FIG. 6 is a fragmentary perspective view illustrating the handle end of the tool shown in FIG. 5.
Figure 8:
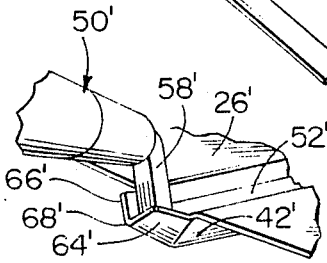
FIG. 8 is a fragmentary perspective view of the handle end of the tool illustrated in FIG. 7.

Referring now more specifically to FIGS. 7 and 8, a modified form of tool is referred to in general by the reference numeral 24'. The tool 24' is substantially identical to the tool 24, except that the rib 42' of the tool 24' is V-shaped in transverse cross-section as opposed to rectangular in transverse cross-sectional. Accordingly, the rib 42' of the tool 24' includes upwardly and outwardly divergent opposite sides 44' and 46' joined at the lower extremity of the rib 42' by a narrow, rounded connecting bight portion 48'. Still further, the handle end of the tool 24' includes a nose incorporating extensions 64' and 66' interconnected by a bight portion extension 68' which is outwardly and upwardly inclined. Otherwise, those components of the tool 24' corresponding to the previously described components of the tool 24 are designed by prime reference numerals indicating the various components of the tool 24.

Of course, the tool 24' is designed to be used in conjunction with insulation panels corresponding to the insulation panels 10, but having V-shaped intersecting grooves formed therein rather than rectangular cross-section intersecting grooves formed therein. Still further, the tool 24' also will have a companion tool (not shown) including a slightly smaller cross-sectional dimension rib 42' for applying a coating corresponding to the finish coating 20 after the tool 24' has been used to apply the initial coating corresponding to the coating 18 to an insulation panel having V-shaped grooves formed therein.

The nose portions at the handle ends of the ribs 42 and 42' of the tools 24 and 24' are extremely important. The nose portions not only insure that the thickness of the coating 18 (as well as the subsequent coating 20) in the bottom and along the sides of the grooves 12 and 14 is of the correct thickness to fully cover the reinforcing mesh 16, but the nose portions also upwardly express from the grooves 12 and 14 excess amounts of the coating 18 from the grooves 12 and 14 so that such excess amounts of the coating 18 may move outwardly away from the grooves 12 and 14 over the outer surface of the associated panel 10 and be smoothed by lower face portions of the panel 26 on opposite sides of the rib 42. The slightly upwardly and outwardly inclined side margins 36 and 38 allow any remaining excess amount of the coating 18 beneath the panel 26 to move outwardly from the side margins of the panel 26. Thereafter, a conventional stainless steel trowel is used over the exterior surface of the coating 18 adjacent but spaced from the grooves 12 and 14 to smooth out any slight excess thickness portions of the coating 18 disposed laterally outwardly of the opposite sides of the path of movement of the tool 24. In this manner, all surfaces of the coating 18 are finished such that they are straight and substantially planar and with all edges defined at the intersection of planar surfaces being straight and regular.

The tool 26 as well as the tool 26' were designed because of a total lack of the availability of tools for applying the coatings 18 and 20 in a manner to ensure that all surfaces are straight and planar and that all edges defined at intersecting surfaces are straight and regular.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. A joint finishing tool for applying a hardenable fluent material coating over and within layers of reinforcing mesh applied over grooved insulation building panels in a manner maintaining a substantially constant cross-sectional shape to the coated grooved zones of said panels, said tool including a single, substantially stiff panel of generally rectangular configuration having upper and lower faces and incorporating first and second opposite end edges and first and second opposite side longitudinal margins, said panel including an elongated, longitudinal extending channel defining zone thereof centrally intermediate said margins, said tool panel being substantially planar between each said side longitudinal margin and said channel defining zone, said channel defining zone defining a channel of substantially constant cross-sectional shape and size opening outwardly of said upper face and a rib of substantially the same cross-sectional shape, but slightly greater cross-sectional size as said channel, projecting outward of the lower face of said panel, said rib including opposite sides formed as angulated portions of said panel projecting below said lower face extending lengthwise of said panel and a connecting bight portion interconnecting and extending between lower portions of said sides remote from said lower face, an elongated handle including base and handgrip ends, said handle being arranged longitudinally of said panel with said base end anchored in said channel and said handgrip end projecting outwardly over one end edge of said panel and being upwardly offset relative to said base end to an elevation spaced above said upper face, said sides including outwardly convergent extensions projecting outwardly of one of said end edges of said panel and said bight portion including an outwardly and upwardly inclined extension extending between and interconnecting said side extensions, said opposite side longitudinal margins being slightly upwardly and outwardly inclined.

2. A joint finishing tool for applying a hardenable fluent material coating over and within layers of reinforcing mesh applied over grooved insulation building panels in a manner maintaining a substantially constant cross-sectional shape to the coated grooved zones of said panels, said tool including a single, substantially stiff panel of generally rectangular configuration having upper and lower faces and incorporating first and second opposite end edges and first and second opposite side longitudinal margins, said panel including an elongated, longitudinal extending channel defining zone thereof centrally intermediate said margins, said tool panel being substantially planar between each said side longitudinal maragin and said channel defining zone said channel defining zone defining a channel of substantially constant cross-sectional shape and size opening outwardly of said upper face and a rib of substantially the same cross-sectional shape, but slightly greater cross-sectional size as said channel, projecting outward of the lower face of said panel, said rib including opposite sides formed as angulated portions of said panel projecting below said lower face extending lengthwise of said panel and a connecting bight portion interconnecting and extending between lower portions of said sides remote from said lower face, an elongated handle including base and handgrip ends, said handle being arranged longitudinally of said panel with said base end anchored in said channel and said handgrip end projecting outwardly over one end edge of said panel and being upwardly offset relative to said base end to an elevation spaced above said upper face, said sides including outwardly convergent extensions projecting outwardly of one of said end edges of said panel and said bight portion including an outwardly and upwardly inclined extension extending between and interconnecting said side extensions said opposite side longitudinal margins being slightly upwardly and outwardly inclined, said base end of said handle being anchored to said bight portion at least substantially independent of said channel sides, whereby said panel may flex slightly to narrow 1 width of said rib responsive to slight variances in the thickness of a coating being applied in a panel groove.

3. The tool of claim 2 wherein said channel is rectangular in cross-section.

4. The tool of claim 2 wherein said channel is triangular in cross-section.

5. The tool of claim 2 wherein said one end edge of said panel from which said extensions project is generally straight on opposite sides of said channel and the opposite ends thereof curves smoothly into said side longitudinal margins.

* * * * *